US009502825B2

(12) United States Patent
Weinstein et al.

(10) Patent No.: US 9,502,825 B2
(45) **Date of Patent: *Nov. 22, 2016**

(54) SHUNT FOR ELECTRICAL CONNECTOR

(71) Applicant: Amphenol Corporation, Wallingford, CT (US)

(72) Inventors: David I. Weinstein, Yorktown Heights, NY (US); Owen R. Barthelmes, Putnam Valley, NY (US); Michael A. Hoyack, Sandy Hook, CT (US)

(73) Assignee: Amphenol Corporation, Wallingford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/978,863

(22) Filed: Dec. 22, 2015

(65) Prior Publication Data

US 2016/0141802 A1 May 19, 2016

Related U.S. Application Data

(63) Continuation of application No. 14/509,464, filed on Oct. 8, 2014, now Pat. No. 9,293,864, which is a continuation of application No. 13/828,944, filed on Mar. 14, 2013, now Pat. No. 8,882,539.

(51) Int. Cl.

| | |
|---|---|
| ***H01R 31/08*** | (2006.01) |
| ***H01R 13/6461*** | (2011.01) |
| ***H01R 4/48*** | (2006.01) |
| ***H01R 13/6585*** | (2011.01) |
| *H01R 12/58* | (2011.01) |
| *H01R 12/71* | (2011.01) |

(52) U.S. Cl.

CPC ..... *H01R 13/6461* (2013.01); *H01R 4/48* (2013.01); *H01R 13/6585* (2013.01); *H01R 31/08* (2013.01); *H01R 12/585* (2013.01); *H01R 12/716* (2013.01); *Y10S 439/941* (2013.01)

(58) Field of Classification Search

CPC ..... H01R 13/6461; H01R 4/48; H01R 12/585; H01R 13/08; H01R 12/716

USPC ..... 439/507–514, 579, 941

See application file for complete search history.

(56) References Cited

U.S. PATENT DOCUMENTS

| | | | |
|---|---|---|---|
| 2,603,681 | A | 7/1952 | Salisbury |
| 2,999,998 | A | 9/1961 | Cole |
| 4,227,765 | A | 10/1980 | Neumann et al. |
| 4,466,048 | A | 8/1984 | Schwab |
| 4,541,032 | A | 9/1985 | Schwab |
| 4,674,809 | A | 6/1987 | Hollyday et al. |
| 4,726,787 | A | 2/1988 | Stine |
| 4,728,301 | A | 3/1988 | Hemmer et al. |

(Continued)

FOREIGN PATENT DOCUMENTS

| | | |
|---|---|---|
| DE | 3230934 | 3/1983 |
| DE | 202012000487 U1 | 2/2012 |
| EP | 1 760 844 | 3/2007 |

*Primary Examiner* — Khiem Nguyen

(74) *Attorney, Agent, or Firm* — Blank Rome LLP

(57) ABSTRACT

A shunt for an electrical connector that comprises a conductive body which has two resilient leg extensions connecting at a hinge, each of the leg extensions terminating at a tail end opposite the hinge. Each of the leg extensions has at least one contact point on an outer surface thereof for engaging a contact of the electrical connector. The leg extensions curve such that they diverge from one another at at least one portion of the conductive body. The at least one contact point is located at this at least one portion.

15 Claims, 3 Drawing Sheets

(56) References Cited

U.S. PATENT DOCUMENTS

| | | | |
|---|---|---|---|
| 4,789,351 | A | 12/1988 | Fisher, Jr. et al. |
| 4,846,731 | A | 7/1989 | Alwine |
| 4,857,014 | A | 8/1989 | Alf et al. |
| 4,925,403 | A | 5/1990 | Zorzy |
| 5,062,808 | A | 11/1991 | Hosler, Sr. |
| 5,137,462 | A | 8/1992 | Casey et al. |
| 5,217,391 | A | 6/1993 | Fisher, Jr. |
| 5,257,161 | A | 10/1993 | Ocerin et al. |
| 5,329,262 | A | 7/1994 | Fisher, Jr. |
| 5,548,088 | A | 8/1996 | Gray et al. |
| 5,647,749 | A | 7/1997 | Atoh et al. |
| 5,700,160 | A | 12/1997 | Lee |
| 5,879,177 | A | 3/1999 | Honma |
| 5,906,508 | A | 5/1999 | Jeffcoat |
| 5,980,290 | A | 11/1999 | Meynier et al. |
| 6,059,577 | A | 5/2000 | Eriksson |
| 6,079,986 | A | 6/2000 | Beshears |
| 6,166,615 | A | 12/2000 | Winslow et al. |
| 6,174,206 | B1 | 1/2001 | Yentile et al. |
| 6,224,421 | B1 | 5/2001 | Maturo, Jr. |
| 6,497,579 | B1 | 12/2002 | Garbini |
| 6,663,434 | B1 | 12/2003 | Wu |
| 6,695,622 | B2 | 2/2004 | Korsunsky et al. |
| 6,773,285 | B2 | 8/2004 | Bernat et al. |
| 6,773,286 | B1 | 8/2004 | Wu |
| 6,814,630 | B1 | 11/2004 | Tomasino |
| 6,827,608 | B2 | 12/2004 | Hall et al. |
| 6,835,079 | B2 | 12/2004 | Gentry et al. |
| 6,908,325 | B2 | 6/2005 | Bernat et al. |
| 6,976,862 | B1 | 12/2005 | Ormazabal Ocerin |
| 7,112,078 | B2 | 9/2006 | Czikora |
| 7,210,941 | B2 | 5/2007 | Rosenberger |
| 7,229,303 | B2 | 6/2007 | Vermoesen et al. |
| 7,306,484 | B1 | 12/2007 | Mahoney et al. |
| 7,442,080 | B1 | 10/2008 | Tsen |
| 7,445,458 | B1 | 11/2008 | Yamane |
| 7,445,467 | B1 | 11/2008 | Matsuo |
| 7,478,475 | B2 | 1/2009 | Hall |
| 7,563,133 | B2 | 7/2009 | Stein |
| 7,645,151 | B2 | 1/2010 | Moll et al. |
| 7,717,716 | B2 | 5/2010 | Dahms |
| 7,731,528 | B2 | 6/2010 | Feldman et al. |
| 7,762,854 | B1 | 7/2010 | Peng |
| 7,896,655 | B1 | 3/2011 | Blasick et al. |
| 8,323,058 | B2 | 12/2012 | Flaherty et al. |
| 8,360,789 | B2 | 1/2013 | Yin et al. |
| 8,568,163 | B2 | 10/2013 | Burris et al. |
| 8,573,983 | B2 | 11/2013 | Zieder |
| 8,597,050 | B2 | 12/2013 | Flaherty et al. |
| 8,734,167 | B2 | 5/2014 | Aimoto |
| 8,801,459 | B2 | 8/2014 | Mrowka |
| 2002/0061670 | A1 | 5/2002 | Havener et al. |
| 2002/0111057 | A1 | 8/2002 | Bernat et al. |
| 2002/0142625 | A1 | 10/2002 | Berghorn et al. |
| 2004/0014334 | A1 | 1/2004 | Lu |
| 2004/0038586 | A1 | 2/2004 | Hall et al. |
| 2004/0229490 | A1 | 11/2004 | Bernat et al. |
| 2005/0037650 | A1 | 2/2005 | Hsu et al. |
| 2006/0024985 | A1 | 2/2006 | Nagata et al. |
| 2006/0194465 | A1 | 8/2006 | Czikora |
| 2006/0258209 | A1 | 11/2006 | Hall |
| 2007/0026698 | A1 | 2/2007 | Rosenberger |
| 2009/0149086 | A1 | 6/2009 | Dahms |
| 2009/0186495 | A1 | 7/2009 | Taylor |
| 2009/0215295 | A1 | 8/2009 | Tseng |
| 2009/0239422 | A1 | 9/2009 | Fukazawa et al. |
| 2009/0264008 | A1 | 10/2009 | Matsuda et al. |
| 2010/0007441 | A1 | 1/2010 | Yagisawa et al. |
| 2010/0075536 | A1 | 3/2010 | Kubo |
| 2011/0151714 | A1 | 6/2011 | Flaherty et al. |
| 2011/0237123 | A1 | 9/2011 | Burris et al. |
| 2011/0237124 | A1 | 9/2011 | Flaherty et al. |
| 2012/0295478 | A1 | 11/2012 | Mrowka |
| 2014/0193995 | A1 | 7/2014 | Barthelmes et al. |
| 2014/0206218 | A1 | 7/2014 | Liu et al. |

SHUNT FOR ELECTRICAL CONNECTOR

RELATED APPLICATION

This application is a continuation of U.S. patent application Ser. No. 14/509,464, filed Oct. 8, 2014, which is a continuation of U.S. patent application Ser. No. 13/828,944, filed Mar. 14, 2013, (now U.S. Pat. No. 8,882,539) the disclosure of both of which is hereby incorporated by reference herein.

FIELD OF THE INVENTION

The present application relates to a shunt for an electrical connector. More specifically, the shunt creates an electrical path to reduce crosstalk between contacts in an electrical connector, such as a radio frequency electrical connector.

BACKGROUND OF THE INVENTION

A radio frequency (RF) connector is an electrical connector designed to work at radio frequencies in the multi-megahertz range. Typically, RF connectors are used in a variety of applications, such as wireless telecommunications applications, including WiFi, PCS, radio, computer networks, test instruments and antenna devices. In one particular application, a plurality of individual connectors are ganged together into a single, larger connector housing for electrically and physically connecting two or more printed circuit board (PCBs) together.

Conventional RF multi-signal connector housings are formed of a metal. These metal housings are advantageous for multi-signal connectors, because they reduce crosstalk between neighboring coaxial lines in a connector. Specifically, because the coaxial signal lines all share a common metal housing, and all make electrical contact with the housing, the housing itself acts as a conductor thereby detuning resonances between the lines. However, the use of metal housings increases crosstalk between connectors at the PCB junction. In particular, at the PCB gap, the metal housing acts as a waveguide and channels all of the signal leakage from one connector across the gap to neighboring connectors.

Replacing the traditional conductive metal housing of an RF connector with a plastic, non-conductive housing decreases this effect at the PCB gap. Specifically, while the same amount of signal will leak from the connector at the PCB junction, it will resonate out in all directions instead of being channeled to the neighboring connector. Thus, crosstalk between connectors is reduced. The use of plastic has further advantages over the use of metal materials for RF connector housings. Plastic is typically less expensive, lighter, and more easily moldable to a desired shape or structure. Thus, the use of plastic decreases cost and provides for easier manufacturing. However, the use of plastic in RF connectors does produce an undesirable effect. Because plastic is non-conductive, the lines within the same connector are no longer electrically connected as they were when a metal housing as used. This causes signals to resonate along the lines within a connector, thereby causing crosstalk between them.

Accordingly, there is a need for a device which detunes resonances between neighboring lines in an RF connector having a plastic housing, thereby reducing crosstalk.

SUMMARY OF THE INVENTION

Accordingly, an exemplary embodiment of the present invention provides a shunt for an electrical connector that comprises a conductive body which has two resilient leg extensions connecting at a hinge, each of the leg extensions terminating at a tail end opposite the hinge. Each of the leg extensions has at least one contact point on an outer surface thereof for engaging a contact of the electrical connector. The leg extensions curve such that they diverge from one another at at least one portion of the conductive body. The at least one contact point is located at this at least one portion.

The present invention also provides an electrical connector that comprises a housing, at least one located within the housing, and a shunt received in the housing. The shunt includes a conductive body which has at least one resilient leg extension terminating at a tail end, and having at least one contact point on an outer surface thereof for engaging the contact. The leg extension is curved such that the leg extension is biased against the at least one contact so that the contact point of the leg extension engages the contact.

The present invention also provides an electrical connector assembly comprising first and second electrical connectors configured to mate with one another. Each electrical connector includes a housing, at least one located within the housing, and a shunt received in the housing. The shunt includes a conductive body which has at least one resilient leg extension terminating at a tail end, and having at least one contact point on an outer surface thereof for engaging the contact. The leg extension is curved such that the leg extension is biased against the at least one contact so that the contact point of the leg extension engages the contact.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
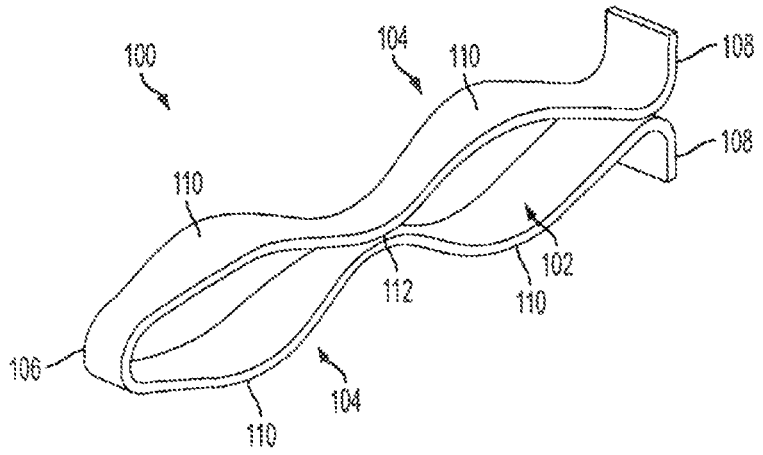
FIG. 1 is perspective view of a shunt in accordance with an exemplary embodiment of the present invention.

Referring to FIGS. 1, 2A, 2B, 3A, and 3B, a shunt 100 for an electrical connector according to an exemplary embodiment of the present invention generally comprises a conductive body 102 having two resilient leg extensions 104 connecting at a hinge 106. The shunt 100 is positioned within an electrical connector, such as connector 200 (FIGS.

2A and 2B), which may be used to connect PCBs. The shunt 100 provides an electrical path through which current can flow, thereby detuning resonances which create crosstalk between contacts within an electrical connector.

Figure 2A:
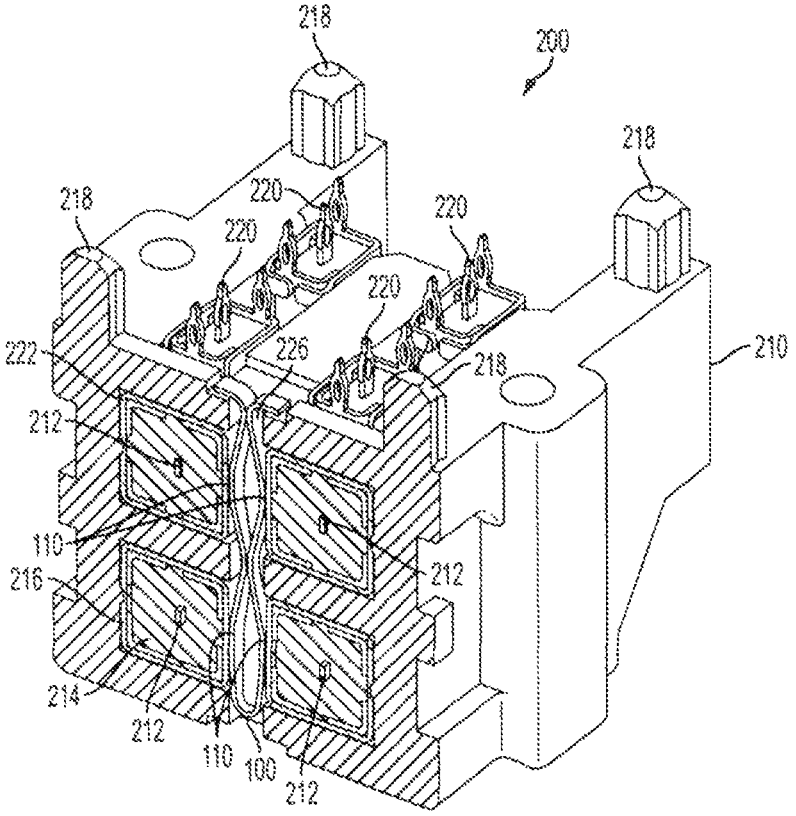
FIG. 2A is a perspective view of an electrical connector in accordance with an exemplary embodiment of the present invention, showing an end of the electrical connector in cross-section and the shunt illustrated in FIG. 1 coupled therewith.

As depicted in FIG. 1, each of the leg extensions 104 of the shunt 100 may terminate at a tail end 108, and each tail end 108 may extend outwardly away from the other. The tail ends 108 are designed to be flush with the connector housing surface that engages the PCB when the shunt is fully positioned within the electrical connector, as seen in FIG. 2A. The design of the leg extensions 104 may be such that each has one or more contact points 110 on an outer surface thereof for engaging a contact or contacts of the electrical connector. The number of contact points 110 may be selected to correspond to the number of contacts in the connector. In a preferred embodiment, there are four contacts 110.

The leg extensions 104 may be curved such that they converge toward one another at a substantially center portion 112 of the conductive body 102. According to one embodiment, the leg extensions 104 make contact with one another at the substantially center portion 112 of the conductive body 102. The leg extensions 104 may also converge toward one another, and make contact, at another point on the conductive body 102 adjacent to the tail ends 108. The leg extensions 104 preferably diverge from one another or curve away from one another at two portions on either side of the center portion 112 of the conductive body 102, such that contact points 110 on the outer surface of the conductive body 102 at those two curved portions can make positive contact with the contacts of the electrical connector. The leg extensions 104 may also diverge from one another or curve away from one another at other portions of the conductive body 102, and each leg extension 104 may have a contact point 110 located at each of those other divergent portions. In one embodiment, the contact points 110 on one leg extension 104 are opposite the contact points 110 on the other leg extension 104.

The shunt 100 may be formed of any conductive material known to one skilled in the art, including but not limited to, spring copper alloys and spring steel alloys. Alternatively, the shunt may be formed of a non-conductive material that is covered in a conductive material. The shunt 100 is electrically conductive so as to redirect currents which cause crosstalk within the electrical connector. The dimensions of the shunt 100 may be adjusted according to the size and structure of the electrical connector for which it is to be used, and the present invention is not limited to any certain size or dimension.

Figure 2B:
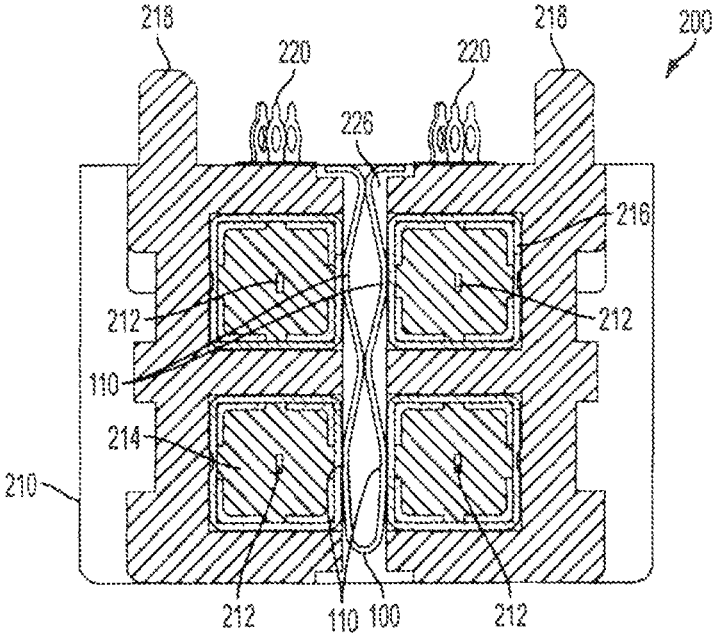
FIG. 2B is an end view of the electrical connector illustrated in FIG. 2A.

As shown in FIGS. 2A and 2B, the electrical connector 200 generally comprises a housing 210, a plurality of contact subassemblies 212, and the shunt 100 of the present invention. The electrical connector may be a male or female connector, and a straight or right angle connector.

The plurality of contact subassemblies 212 may be formed of one or more conductive contacts. The contacts may be formed of any conventional material, such as copper, hardened beryllium copper, gold- or nickel-plating, and the like, for carrying electrical signals. The contacts 212 are preferably enclosed by an insulator material 214, which is then enclosed in a conductive outer shield 216. The outer shield 216 may be made of any conductive material known to one skilled in the art, including, but not limited to, phosphor bronze and/or selective gold- or nickel-plating, and the like.

The plurality of contact subassemblies 212 physically and electrically interface with the PCB. As shown in FIGS. 2A and 2B, the connector 200 may comprise four contact subassemblies 212. It is appreciated, however, that any number of contacts known to one skilled in the art to be suitable for PCB electrical connectors may be used, including, but not limited to, two, six, eight or more contacts. The contact subassemblies 212 are located within the housing 210 and are preferably arranged in a straight or staggered row configuration. As shown in FIG. 2A, in order to optimize contact with the shunt 100, the contact subassemblies 212 are arranged in two rows, having two contact subassemblies 212 per row. The contact subassemblies 212 may include tails 220 which protrude from a plurality of openings 222 on the housing 210 and which engage the surface of the PCB.

The housing 210 of the electrical connector 200 may be any shape known to one skilled in the art to be useful for connecting PCBs. According to one embodiment, the housing is substantially non-conductive. For example, the housing may be substantially formed of polybutylene terephthalate (PBT), liquid-crystal polymer, polyamides (e.g., Nylon), or polyetheretherketone (PEEK), to name a few. As shown in FIGS. 2A and 2B, the housing 210 may have a plurality of locating projections 218 which allow the connector 200 to be located on the PCB (not shown). However, any method known to one skilled in the art for locating an electrical connector on an underlying PCB may be utilized. Further, the housing 210 may have a plurality of openings 222 arranged in a grid-like pattern on a surface through which the contact tails 220 of the electrical contact subassemblies 212 extend. Preferably, the housing 210 has a slot 226, opening at the PCB and extending through the housing 210 and between the contact subassemblies 212, for receiving the shunt 100.

When a signal is carried through the electrical connector 200, RF fields inevitably leak at areas where a gap is created, such as at PCB solder areas, conductive traces, connector interfaces and joints in the conductive outer shields 216 of contact subassemblies 212. This RF leakage induces currents to flow along the conductive outer shields 216 of the contact subassemblies 212. When that occurs, a signal resonates along the length of the outer shield 216, thereby creating crosstalk between neighboring contacts 212.

To resolve that crosstalk issue, the shunt 100 of the present invention is positioned within the housing 210 in the slot 226 between the contact subassemblies 212. Because the shunt 100 is conductive, it creates a new path for the current flowing along the outer shield 216 of the contact 212. The shunt 100 makes the current path shorter as compared to the outer shield 216, thereby increasing the resonant frequency of the conductive body (i.e., the shunt 100) to a frequency band that is so high that it does not interfere with neighboring contact subassemblies 212.

Because the leg extensions 104 of the shunt 100 are resilient, they resist insertion through the opening 226. Once pushed fully into the housing 210 and slot 226, the shunt 100 presses against the outer shields 216 of the plurality of contact subassemblies 212 at the contact points 110, thereby making positive electrical contact therebetween. The pressure exerted on the shunt 100 when positioned within the slot 226 of the housing 210 allows the shunt 100 to remain in place without shifting within the housing 210. The tail ends 108 prevent the shunt 100 from being over-inserted into the slot 226, or from pushing through the housing 210, and they ensure proper positioning in the assembly.

Figure 3A:
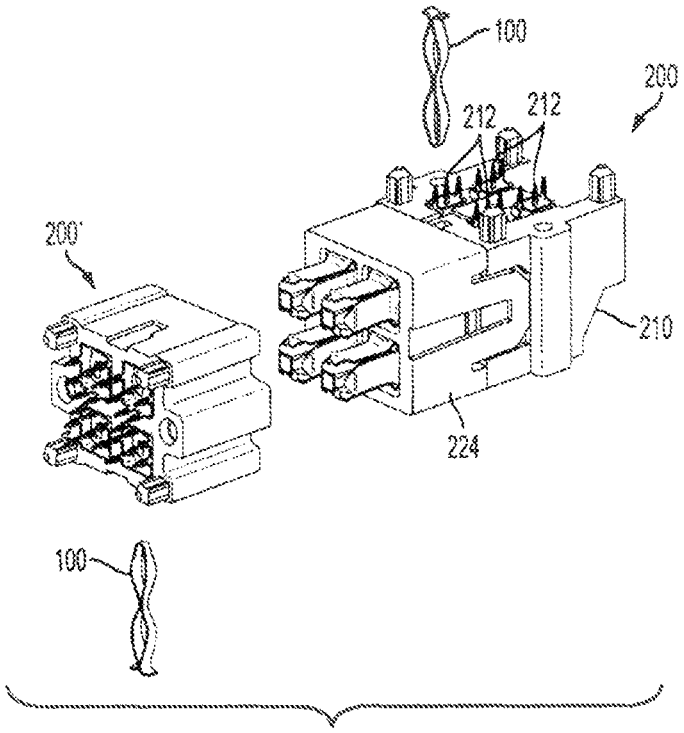
FIG. 3A is an exploded perspective view of the electrical connector of FIGS. 2A and 2B and a mating electrical connector, showing the shunt illustrated in FIG. 1 being inserted into each electrical connector.
Figure 3B:
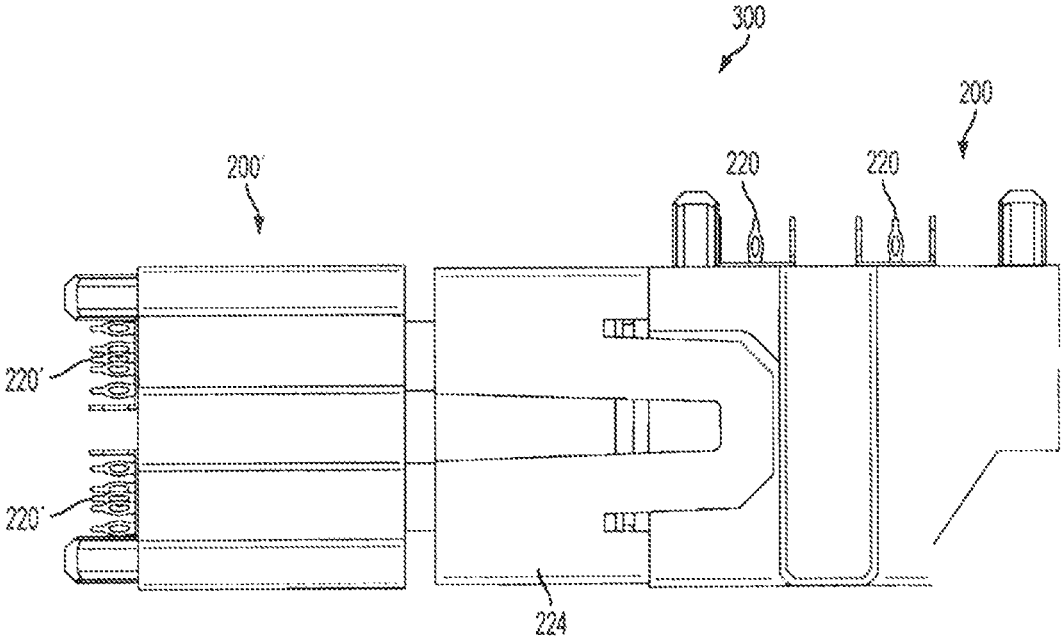
FIG. 3B is a side elevational view of the mating connectors of FIG. 3A fully assembled.

Referring to FIGS. 3A and 3B, the electrical connector 200 may be connected to a mating electrical connector 200' that is also configured to be mounted to a PCB. The electrical connector 200 carries a signal from one PCB (e.g., a motherboard), through the mating electrical connector 200' to a second PCB (e.g., a daughter board), to which electrical connector 200' is connected. An adapter 224 may also be used such that the connector 200 can mate with any type of electrical connector, male or female. The electrical connector may have a right angle configuration or a straight configuration. As shown in FIG. 3A, the electrical connector 200 has a right angle configuration, whereby the plurality of contact subassemblies 212 form right angles within the connector housing 210, as known in the art. The electrical connector 200' may have a straight configuration, whereby its contact subassemblies generally extend in one direction within its housing, as is known in the art. Like connector 200, connector 200' preferably incorporates the shunt 100 of the present invention to reduce crosstalk.

Referring to FIG. 3B, an electrical connector assembly 300 of the connectors 200 and 200' is illustrated. The adapter 224 may be attached to the first connector 200, such that it can be mated with the second connector 200'. However, one skilled in the art will recognize that the assembly 300 may comprise a first connector and a second connector which are configured to mate without the need for an adapter 224. The first connector 200 is connected to a PCB via the tails 220 of the contact subassemblies 212, and the second connector 200' is similarly connected to a different PCB via the tails 220'. A continuous signal path is formed between the connectors, and by incorporating the shunt 100 into each connector, crosstalk between the contact subassemblies in each connector is reduced.

While particular embodiments have been chosen to illustrate the invention, it will be understood by those skilled in the art that various changes and modifications can be made therein without departing from the scope of the invention as defined in the appended claims.

What is claimed is:

1. A shunt for an electrical connector, comprising:

a conductive body having two resilient leg extensions connecting at a hinge, each of said leg extensions terminating at a tail end opposite said hinge, and each of said leg extensions having at least one contact point on an outer surface thereof for engaging a contact of the electrical connector, wherein said leg extensions curve such that said leg extensions diverge from one another at least one portion of said conductive body, said at least one contact point of each of said leg extensions being located at said at least one portion, and said leg extensions contact another at tail ends thereof.

2. The shunt according to claim 1, wherein said leg extensions diverge from one another at two spaced portions of said conductive body; and each of said leg extensions has a contact point being located at each of said two portions.

3. The shunt according to claim 2, wherein said contact points on one of said leg extensions are located opposite said contact points on the other of said leg extensions.

4. An electrical connector, comprising:

a housing;

a plurality of contacts located within said housing; and a shunt received in said housing, said shunt including, a conductive body having at least one resilient leg extension, said leg extension terminating at a tail end and having at least first and second contact points spaced from one another on an outer surface thereof, each of said first and second contact points engaging at least one of said plurality contacts, said leg extension being curved at said first and second contact points such that said leg extension is biased against said plurality of contacts so that said first and second contact points of said leg extension engage said at least one of said plurality of contacts.

5. The electrical connector according to claim 4, further comprising a second leg extension biased against one of said plurality of contacts located in said housing.

6. The electrical connector according to claim 5, wherein said leg extensions are connected by a hinge opposite tail ends thereof, said hinge biases said leg extension outwardly.

7. The electrical connector according to claim 6, wherein each of said leg extensions curve such that said leg extensions contact one another at said tail ends thereof.

8. The electrical connector according to claim 7, wherein said contact points on one of said leg extensions are located opposite said contact points on the other of said leg extensions.

9. The electrical connector according to claim 4, wherein said housing is substantially non-conductive and said contact is formed of conductive material.

10. The electrical connector according to claim 4, wherein said housing includes a slot for receiving said shunt.

11. The electrical connector according to claim 4, wherein said plurality of contacts are arranged in a plurality of rows.

12. An electrical connector assembly, comprising:

first and second electrical connectors configured to mate with one another, each electrical connector including, a housing;

first and second contacts located within said housing; and a shunt received in said housing, said shunt including, a conductive body having first and second resilient leg, extensions each terminating at a tail end and each having at least one contact point on an outer surface thereof for engaging said first and second contacts, respectively, each of said leg extensions being curved such that each of said leg extensions is biased against said first and second contacts, respectively, so that said at least one contact--point of each of said leg extensions engages said first and second contacts, respectively, and said leg extensions contacting one another at a substantially center portion.

13. The electrical connector assembly according to claim 12, wherein said leg extensions are connected by a hinge opposite said tail ends thereof, said hinge biases said leg extension outwardly.

14. The electrical connector assembly according to claim 13, wherein said leg extensions diverge from one another at two portions other than said center portion, said contact points being located at said two portions, respectively.

15. The electrical co assembly according to claim 12, wherein said housing includes a slot for receiving said shunt.

* * * * *